US009653246B2

(12) United States Patent
Kato

(10) Patent No.: US 9,653,246 B2
(45) Date of Patent: May 16, 2017

(54) MAGNETRON

(71) Applicant: Toshiba Hokuto Electronics Corporation, Asahikawa-Shi, Hokkaido (JP)

(72) Inventor: Naoya Kato, Hokkaido (JP)

(73) Assignee: Toshiba Hokuto Electronics Corporation, Asahikawa-shi, Hokkaido (JP)

( * ) Notice: Subject to any disclaimer, the term of this patent is extended or adjusted under 35 U.S.C. 154(b) by 0 days.

(21) Appl. No.: 14/950,818

(22) Filed: Nov. 24, 2015

(65) Prior Publication Data

US 2016/0163494 A1 Jun. 9, 2016

(30) Foreign Application Priority Data

Dec. 3, 2014 (JP) ..... 2014-245341

(51) Int. Cl.
*H01J 25/50* (2006.01)
*H01J 23/04* (2006.01)
(Continued)

(52) U.S. Cl.
CPC ..... *H01J 25/50* (2013.01); *H01J 23/04* (2013.01); *H01J 23/05* (2013.01); *H01J 23/10* (2013.01); *H01J 25/52* (2013.01); *H01J 25/587* (2013.01)

(58) Field of Classification Search
CPC .... H01J 2225/60; H01J 2225/50; H01J 25/58; H01J 3/026; H01J 37/3461; H01J 2223/213; H01J 23/213; H01J 23/10; H01J 25/587; H01J 9/26; H01J 23/05; H01J 23/22; H01J 25/50; H01J 2225/587; H01J 23/087; H03B 9/10
See application file for complete search history.

(56) References Cited

U.S. PATENT DOCUMENTS 4,855,645 A 8/1989 Kinuno et al.
5,049,782 A 9/1991 Aiga et al.
(Continued)

FOREIGN PATENT DOCUMENTS

EP 0263491 A2 4/1988
EP 0327116 A1 8/1989
(Continued)

OTHER PUBLICATIONS

EP 08 29 0823, European Search Report, Completion date Mar. 9, 2010.
(Continued)

*Primary Examiner* — Vibol Tan
(74) *Attorney, Agent, or Firm* — Banner & Witcoff, Ltd.

(57) ABSTRACT

To provide a magnetron improved in high efficiency and load stability while suppressing costs. By shortening the height of vane Vh so that the ratio of the height of vane Vh to a gap between end hats EHg (EHg/Vh) satisfies a condition 1.12≤EHg/Vh≤1.26, an input side pole piece-vane gap IPpvg becomes larger than an output side pole piece-vane gap OPpvg, and an input side end hat-vane gap IPevg becomes larger than an output side end hat-vane gap OPevg, load stability at high efficiency can be improved while shortening the height of vane Vh. Therefore, it is possible to provide a magnetron improved in high efficiency and load stability while suppressing costs.

5 Claims, 11 Drawing Sheets

(51) Int. Cl.

| | |
|---|---|
| ***H01J 25/52*** | (2006.01) |
| ***H01J 25/587*** | (2006.01) |
| ***H01J 23/05*** | (2006.01) |
| ***H01J 23/10*** | (2006.01) |

(56) References Cited

U.S. PATENT DOCUMENTS

| | | | | |
|---|---|---|---|---|
| 5,635,797 | A * | 6/1997 | Kitakaze | H01J 23/05 315/39.51 |
| 5,635,798 | A * | 6/1997 | Ogura | H01J 23/10 315/39.51 |
| 5,798,613 | A * | 8/1998 | Lee | H01J 25/587 315/39.51 |
| 5,861,716 | A | 1/1999 | Ogura | |
| 6,653,788 | B2 | 11/2003 | Ogura et al. | |
| 6,756,735 | B2 | 6/2004 | Lee et al. | |
| 6,844,680 | B2 | 1/2005 | Yoshihara et al. | |
| 6,960,283 | B2 | 11/2005 | Lee et al. | |
| 6,972,522 | B2 | 12/2005 | Yang | |
| 7,023,137 | B2 | 4/2006 | Ishii et al. | |
| 7,053,556 | B2 | 5/2006 | Yoshihara et al. | |
| 7,135,820 | B2 | 11/2006 | Shon et al. | |
| 7,235,929 | B2 | 6/2007 | Inami | |
| 8,120,258 | B2 * | 2/2012 | Kumakura | H01J 23/10 315/39.51 |
| 8,525,413 | B2 * | 9/2013 | Higashi | 315/39.51 |
| 2004/0140207 | A1 | 7/2004 | Lee et al. | |
| 2006/0219548 | A1 | 10/2006 | Baek et al. | |
| 2007/0296515 | A1 * | 12/2007 | Kato | H01J 23/10 332/132 |

FOREIGN PATENT DOCUMENTS

| | | | |
|---|---|---|---|
| EP | 1562218 | A2 | 8/2005 |
| EP | 1594152 | A2 | 11/2005 |
| EP | 1870923 | A2 | 12/2007 |
| EP | 2037482 | A2 | 3/2009 |
| EP | 2237304 | A2 | 10/2010 |
| JP | 63-110527 | | 5/1988 |
| JP | 02-0300326 | A | 1/1990 |
| JP | 06223729 | | 8/1994 |
| JP | 07302548 | | 11/1995 |
| JP | 08167383 | | 6/1996 |
| JP | 3329509 | B2 | 9/2002 |
| JP | 2002343262 | A | 11/2002 |
| JP | 2003132809 | A | 5/2003 |
| JP | 2006260976 | A | 9/2006 |
| JP | 2007-335351 | A | 12/2007 |
| JP | 05-035531 | B2 | 9/2012 |

OTHER PUBLICATIONS

Office Action in JP 2006-168505, mailed Sep. 20, 2011.
"Vacuum Tubes," Karl R. Spangenberg, McGrawhill Book Company, Inc., 1948, pp. 660-663 and preface.
JP Notice of Reasons for Refusal received in corresponding JP Application 2007-235511, dated Jul. 23, 2009.
JP Notice of Reasons for Refusal received in corresponding JP Application 2007-235511, dated Oct. 13, 2009.
Apr. 22, 2016 (EP) Extended Search Report—App 15196283.4.
Hayashi, Yasuhiro; "Toshiba Review"—2015, vol. 70, No. 2 (Mar. 28, 2015).
Kato, Naoya; "2M403/E4500 Magentron with High Efficiency and Improved Load Stability for Microwave Ovens," from "Toshiba Review"—2015, vol. 70, No. 2 (Mar. 28, 2015) (Japanese original and English Translation).

* cited by examiner

FIG. 14

| | Vh | EHg | IPevg | OPevg | PPg | IPpvg | OPpvg | IPepg | IPpph | OPpph | IPppd | OPppd | 2ra | 2rc | rc/ra |
|---|---|---|---|---|---|---|---|---|---|---|---|---|---|---|---|
| No.1 | 9.5 | 10.5 | 1 | 0 | 12.7 | 1.6 | 1.6 | 0.6 | 5.4 | 5.4 | 16 | 12 | 9.08 | 3.9 | 0.430 |
| No.2 | 8.5 | 9.75 | 1 | 0.25 | 11.7 | 1.6 | 1.6 | 0.6 | 5.4 | 5.4 | 16 | 16 | 9.08 | 3.9 | 0.430 |
| No.3 | 8.0 | 8.9 | 0.8 | 0.1 | 10.9 | 1.45 | 1.45 | 0.65 | 6.25 | 6.25 | 14 | 12 | 8.10 | 3.7 | 0.457 |
| No.4 | 8.0 | 8.9 | 0.85 | 0.05 | 10.8 | 1.4 | 1.4 | 0.55 | 5.85 | 5.85 | 16 | 12 | 8.80 | 3.9 | 0.443 |
| No.5 | 7.5 | 8.95 | 1.35 | 0.1 | 10.3 | 1.5 | 1.3 | 0.15 | 6.25 | 6.25 | 14 | 12 | 8.00 | 3.7 | 0.463 |

| | Ehg/Vh | PPg/Vh | Ipppd/Oppd | OPevg+IPevg |
|---|---|---|---|---|
| No.1 | 1.11 | 1.34 | 1.33 | 1.0 |
| No.2 | 1.15 | 1.38 | 1.00 | 1.3 |
| No.3 | 1.11 | 1.36 | 1.17 | 0.9 |
| No.4 | 1.11 | 1.35 | 1.33 | 0.9 |
| No.5 | 1.19 | 1.37 | 1.17 | 1.5 |

No. 3 Reference magnetron 100
No. 5 Magnetron 1

MAGNETRON

CROSS REFERENCES TO RELATED APPLICATIONS

This application is based upon and claims the benefit of priority from the prior Japanese Patent Application No. 2014-245341 filed on Dec. 3, 2014; the entire content of which is incorporated herein by reference.

FIELD

The present invention relates to a magnetron, and is suitably applied to a continuous wave magnetron used in microwave heating equipment such as microwave ovens.

BACKGROUND OF THE INVENTION

General magnetrons for microwave ovens, which oscillates to generate 2,450 MHz-band microwaves, includes an anode cylinder and a plurality of vanes. The vanes are radially disposed inside the anode cylinder. In an electron interaction space surrounded by free ends of the plurality of vanes, a spiral cathode is disposed along the central axis of the anode cylinder. To both ends of the cathode, an input side end hat and an output side end hat are fixed respectively. To both ends of the anode cylinder, an input side pole piece and an output side pole piece which are almost funnel-shaped are fixed respectively. On the outside of each of the input side pole piece and the output side pole piece, a ring-shaped magnet is disposed (see, for example, Patent Document 1).

[Patent Document 1] Japanese Patent Application Laid-Open Publication No. 2007-335351

In recent years, as for magnetrons, further high efficiency, improvement of oscillation stability to load has been required while suppressing costs. Practically, for instance, in order to enhance magnetic field intensity in an electron interaction space and attain high efficiency while suppressing costs, it is effective that makes a gap between an input side magnet and an output side magnet narrower. To make the gap narrower, however, if simply reducing a size of an anode cylinder and each section in it in a tube axis direction, oscillation stability (load stability) lowers.

In view of the foregoing, it is desirable to provide a magnetron improved in high efficiency and load stability while suppressing costs.

BRIEF SUMMARY OF THE INVENTION

To achieve the above object, a magnetron of the present invention is characterized by including: an anode cylinder extending cylindrically along the central axis of the magnetron extending from an input side to an output side; a plurality of vanes extending from an inner surface of the anode cylinder toward the central axis with free ends forming a vane inscribed circle; a cathode disposed along the central axis in the vane inscribed circle formed by the free ends of the plurality of vanes; an input side end hat and an output side end hat respectively fixed to the input side end and the output side end of the cathode; an input side pole piece and an output side pole piece respectively disposed at the input side end and the output side end of the anode cylinder in the central axis direction to lead magnetic flux into an electron interaction space between the free ends of the plurality of vanes and the cathode; and magnets respectively disposed on the outside of the input side pole piece and the output side pole piece in the central axis direction;

characterized in that when a gap between the input side end hat and output side end hat is represented by gap between end hats EHg, the length of the vane in the central axis direction by height of vane Vh, a gap between the input side end hat and the input side end of the vane by input side end hat-vane gap IPevg, a gap between the output side end hat and the output side end of the vane by output side end hat-vane gap OPevg, a gap between a central part of a flat surface of the input side pole piece and the input side end of the vane by input side pole piece-vane gap IPpvg, and a gap between a central part of a flat surface of the output side pole piece and the output side end of the vane by output side pole piece-vane gap OPpvg, conditional expressions $1.12 \leq EHg/Vh \leq 1.26$, $IPpvg > OPpvg$, $IPevg > OPevg$ are satisfied.

The nature, principle and utility of the present invention will become more apparent from the following detailed description when read in conjunction with the accompanying drawings in which like parts are designated by like reference numerals or characters.

BRIEF DESCRIPTION OF THE DRAWINGS

The above and other features and advantage of the present invention will become apparent from the discussion herein below of specific, illustrative embodiments thereof presented in conjunction with accompanying drawings, in which:

FIG. 14 is a table showing the length of major portions of a plurality of magnetrons including a magnetron according to an embodiment of the present invention;

DETAILED DESCRIPTION OF THE INVENTION

Preferred embodiments of a magnetron of the present invention will be described with reference to the accompanying drawings:

Incidentally, embodiments described below are given for illustrative purposes only, and the present invention is not limited to those embodiments.

Figure 1:
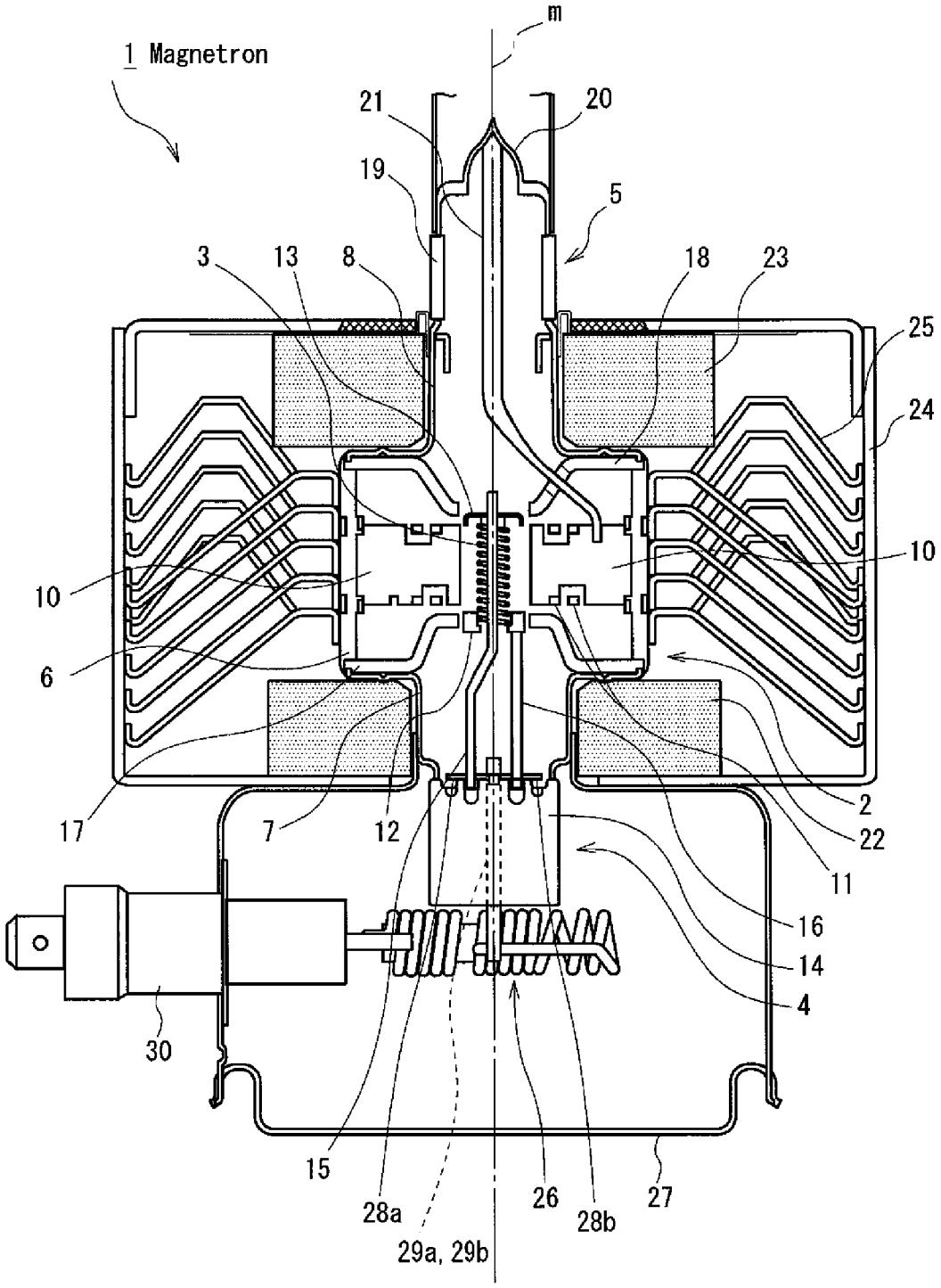
FIG. 1 is a longitudinal cross-sectional view of an entire magnetron according to an embodiment of the present invention.

FIG. 1 is a longitudinal cross-sectional view schematically showing a magnetron 1 according to the present embodiment. The magnetron 1 is a magnetron for microwave ovens that generate a 2,450 MHz-band fundamental wave. The magnetron 1 includes, as a main component, an anode structure 2 that generates a 2,450 MHz-band fundamental wave. Below the anode structure 2, an input unit 4, which supplies power to a cathode 3 located at the center of the anode structure 2, is disposed. Above the anode structure 2, an output unit 5, which leads microwaves generated from the anode structure 2 out of a tube (or magnetron 1), is disposed.

The input unit 4 and the output unit 5 are joined to an anode cylinder 6 of the anode structure 2 in a vacuum-secure manner by an input side metal sealing member 7 and an output side metal sealing member 8.

The anode structure 2 includes the anode cylinder 6, a plurality of vanes 10 (e.g. 10 vanes), and two large and small strap rings 11. The anode cylinder 6 is made of copper, for example, and is formed into a cylindrical shape. The anode cylinder 6 is disposed in such a way that the central axis thereof passes through a tube axis m, or the central axis of the magnetron 1.

Each of the vanes 10 is made of copper, for example, and is formed into a plate shape. Inside the anode cylinder 6, the vanes 10 are radially disposed around the tube axis m. An outer end of each vane 10 is joined to an inner peripheral surface of the anode cylinder 6, an inner end of each vane 10 is a free end. A cylindrical space surrounded by the free ends of the plurality of vanes 10 serves as an electron interaction space. The two large and small strap rings 11 are fixed to both upper and lower ends in the direction of the tube axis m of the plurality of vanes 10 respectively.

In the electron interaction space surrounded by the free ends of the plurality of vanes 10, the spiral cathode 3 is provided along the tube axis m. The cathode 3 is disposed away from the free ends of the plurality of vanes 10. The anode structure 2 and the cathode 3 work as a resonance portion of the magnetron 1.

On an upper and a lower end of the cathode 3, end hats 12 and 13 are fixed in order to prevent electrons from leakage. The end hat 12 located at the input side lower end (this is referred to as input side end hat) is formed into a ring shape. The end hat 13 located at upper end positioned at an output side (this is referred to as output side end hat) is formed on a disc.

The input unit 4 located below the anode cylinder 6 includes a ceramic stem 14; a center support rod 15 and a side support rod 16 fixed to the ceramic stem 14 through sealing plates 28*a* and 28*b*. The center support rod 15 passes through a central hole of the input side end hat 12 of the cathode 3 and then through the center of the cathode 3 in the direction of the tube axis m, and is joined to the output side end hat 13 of the cathode 3. The center support rod 15 is electrically connected to the cathode 3.

The side support rod 16 is joined to the input side end hat 12 of the cathode 3. The side support rod 16 is electrically connected to the cathode 3 via the input side end hat 12. The center support rod 15 and the side support rod 16 are designed to support the cathode 3 and supply current to the cathode 3.

Each of the sealing plates 28*a* and 28*b* is fixed to the ceramic stem 14 while keeping airtight. Terminals 29*a* and 29*b* passing through the stem 14 are fixed to the sealing plates 28*a* and 28*b* in an airtight manner respectively. The other end of the terminals 29*a* and 29*b* is connected to one end of each coil of a filter circuit 26. The other end of each coil of the filter circuit 26 is connected to a terminal of a feedthrough capacitor 30.

On an inner side of the lower end (input side end) of the anode cylinder 6 and on an inner side of the upper end (output side end), a pair of pole pieces 17 and 18 are provided in such a way that the space between the input side end hat 12 and the output side end hat 13 is sandwiched and that the pole pieces 17 and 18 face each other.

A central portion of the input side pole piece 17 has a through-hole. The input side pole piece 17 is substantially formed into a shape of funnel that spreads around the through-hole toward the input side (lower side). The input side pole piece 17 is disposed in such a way that the tube axis m passes through the center of the through-hole.

Figure 2:
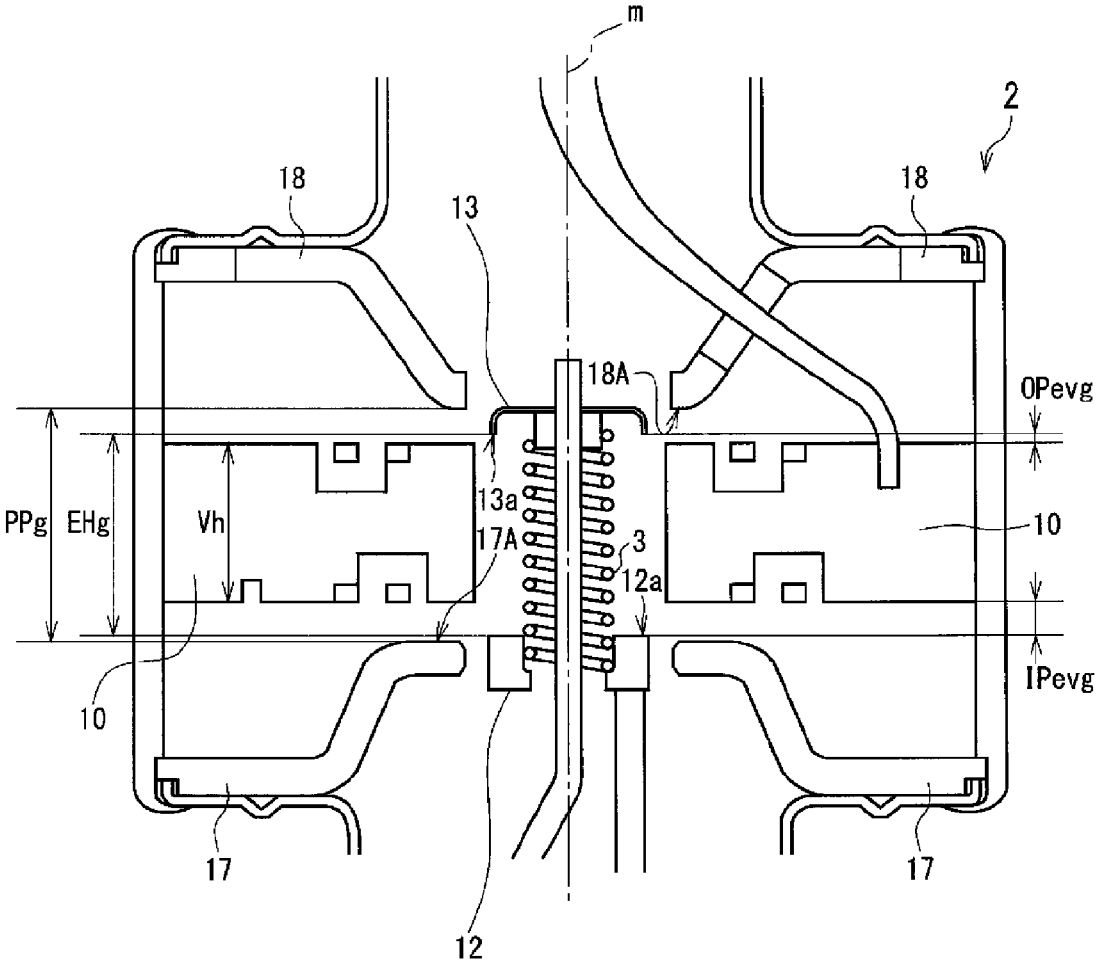
FIG. 2 is a longitudinal cross-sectional view showing dimensions of major portions of a magnetron according to an embodiment of the present invention.

A central portion of the output side pole piece 18 has a through-hole whose diameter is slightly larger than the output side end hat 13. The output side pole piece 18 is substantially formed into a shape of funnel that spreads around the through-hole toward the output side (upper side). The output side pole piece 18 is disposed in such a way that the tube axis m passes through the center of the through-hole. Incidentally, the input side pole piece 17 and output side pole piece 18 both have a substantially funnel shape as a whole, and a flat surface 17A, 18A formed at the center portion, but differ in the diameter of these flat surfaces 17A and 18A as shown in FIG. 2.

To the input side pole piece 17, an upper end of the substantially cylindrical metal sealing member 7, which extends in the direction of the tube axis m, is fixed. The metal sealing member 7 is also in contact with the lower end of the anode cylinder 6. To the output side pole piece 18, a lower end of the substantially cylindrical metal sealing member 8, which extends in the direction of the tube axis m, is fixed. The metal sealing member 8 is also in contact with the upper end of the anode cylinder 6 in airtight state.

To the lower end of the input side metal sealing member 7, the ceramic stem 14, which is part of the input unit 4, is joined in airtight state. That is, the center support rod 15 and side support rod 16, which are fixed to the ceramic stem 14 through the sealing plate 28*a* and sealing plate 28*b*, go inside the metal sealing member 7 to be connected to the cathode 3.

To the upper end of the output side metal sealing member 8, an insulating cylinder 19, which is part of the output unit 5, is joined in airtight state. To an upper end of the insulating cylinder 19, an exhaust tube 20 is joined in airtight state. An antenna 21 that is led out from one of the plurality of vanes 10 passes through the output side pole piece 18 and extends inside the metal sealing member 8 toward the upper end thereof; the tip of the antenna 21 is held by the exhaust tube 20 and thereby fixed in airtight state.

Outside the metal sealing members 7 and 8, a pair of ring-shaped magnets 22 and 23 are provided in such a way that the anode cylinder 6 is sandwiched in the direction of the tube axis m and that the magnets 22 and 23 face each other. Magnetic force is introduced into a cylindrical space surrounded by free ends of the vane 10, which is disposed on the inner circumference of the anode cylinder 6 by the pole pieces 17, 18: the pair of magnets 22 and 23 generate a magnetic field in the direction of the tube axis m.

The anode cylinder 6 and the magnets 22 and 23 are covered with a yoke 24; the pair of magnets 22 and 23 and the yoke 24 constitute a strong magnetic circuit.

Between the anode cylinder 6 and the yoke 24, a radiator 25 is provided. Radiation heat from the cathode 3 is conducted to the radiator 25 through the anode structure 2, and is discharged outside the magnetron 1. The cathode 3 is connected to the filter circuit 26, which includes a coil and a feedthrough capacitor, through the center support rod 15 and side support rod 16. The filter circuit 26 is housed in a filter box 27. The configuration of the magnetron 1 has been outlined above.

Figure 3:
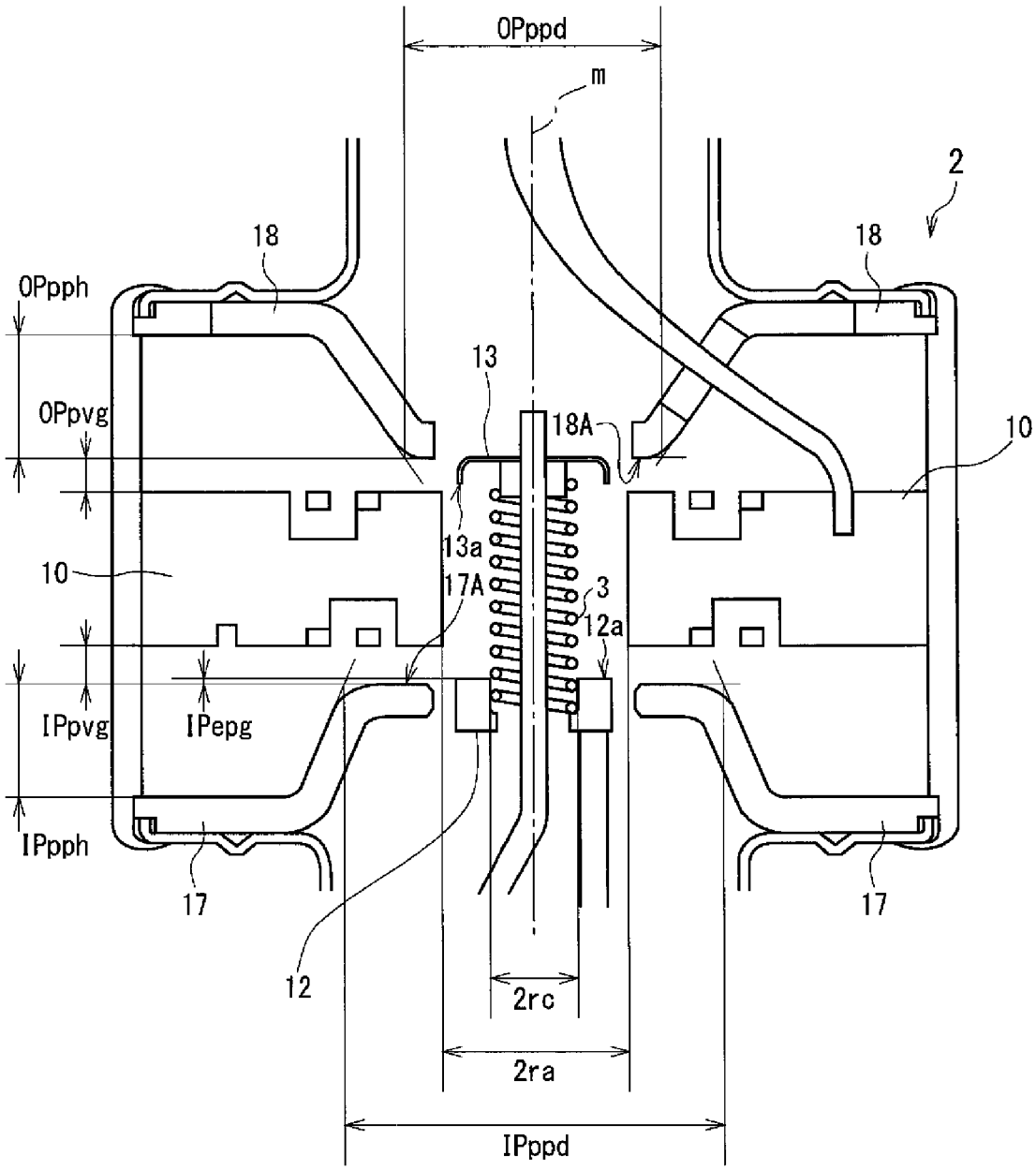
FIG. 3 is a longitudinal cross-sectional view showing dimensions of major portions of a magnetron according to an embodiment of the present invention.

With the use of FIGS. 2 and 3, the anode structure 2 and cathode 3 being the resonance section of the magnetron 1 will be described in more detail. FIGS. 2 and 3 are longitudinal cross-sections views of the anode structure 2 and cathode 3, and are diagrams showing the size, position and spacing of each portion constituting the anode structure 2 and cathode 3.

In the following description, the length of the vanes 10 in the direction of the tube axis m (this is set as height) is represented by height of vane Vh. A gap between an upper end 12*a* of the input side end hat 12 (an end closing to the input side of the vanes 10) and a lower end of the output side output side end hat 13 (an end closing to the output side of the vanes 10) in the direction of the tube axis m is represented by gap between end hats EHg. A gap between the upper end 12*a* of the input side end hat 12 and the lower end of the vanes 10 (an end on the input side) in the direction of the tube axis m is represented by input side end hat-vane gap IPevg. A gap between a lower end 13*a* of the output side end hat 13 and an upper end of the vanes 10 (an end on the output side) in the direction of the tube axis m is represented by output side end hat-vane gap OPevg. A gap between a flat surface 17A of the input side pole piece 17 and a flat surface 18A of the output side pole piece 18 in the direction of the tube axis m is represented by gap between pole pieces PPg. A gap between the flat surface 17A of the input side pole piece 17 and the lower end of the vanes 10 in the direction of the tube axis m is represented by input side pole piece-vane gap IPpvg. A gap between the flat surface 18A of the output side pall piece 18 and the upper end of the vanes 10 in the direction of the tube axis m is represented by output side pole piece-vane gap OPpvg. A gap between the upper end 12*a* of the input side end hat 12 and the flat surface 17A of the input side pole piece 17 in the direction of the tube axis m is represented by input side end hat-pole piece gap IPepg. A length from the flat surface 17A of the input side pole piece 17 to the inner surface of the outer peripheral part of the magnetron in the direction of the tube axis m is represented by height of input side pole piece IPpph. A length from the flat surface 18A of the output side pole piece 18 to the inner surface of the outer peripheral part of the magnetron in the direction of the tube axis m is represented by height of output side pole piece OPpph. An outer diameter of the flat surface 17A of the input side pole piece 17 is represented by flat diameter of input side pole piece IPppd. An outer diameter of the flat surface 18A of the output side pole piece 18 is represented by flat diameter of output side pole piece OPppd. A diameter of a vane inscribed circle inscribed to the free ends of the vanes 10 is represented by diameter of vane inscribed circle 2 ra. And a diameter of the outer periphery of the cathode 3 is represented by diameter of cathode 2 rc. In addition, a vane inscribed circle radius is represented by ra, and a cathode radius by rc. Note that these sizes are read in mm.

The magnetron 1 of this embodiment is designed so that the vane height Vh is 7.5 [mm]; the end hats gap EHg is 8.95 [mm]; the input side end hat-vane gap IPevg is 1.35 [mm]; the output side end hat-vane gap OPevg is 0.1 [mm]; the pole pieces gap PPg is 10.3 [mm]; the input side pole piece-vane gap IPpvg is 1.50 [mm]; the output side pole piece-vane gap OPpvg is 1.30 [mm]; the input side end hat-pole piece gap IPepg is 0.15 [mm]; both the input side pole piece height IPpph and output side pole piece height OPpph are 6.25 [mm]; the input side pole piece flat diameter IPppd is 14.00 [mm]; the output side pole piece flat diameter OPppd is 12.00 [mm]; the vane inscribed circle diameter 2 ra is 8.00 [mm]; and the cathode diameter 2 rc is 3.7 [mm].

Figure 4:
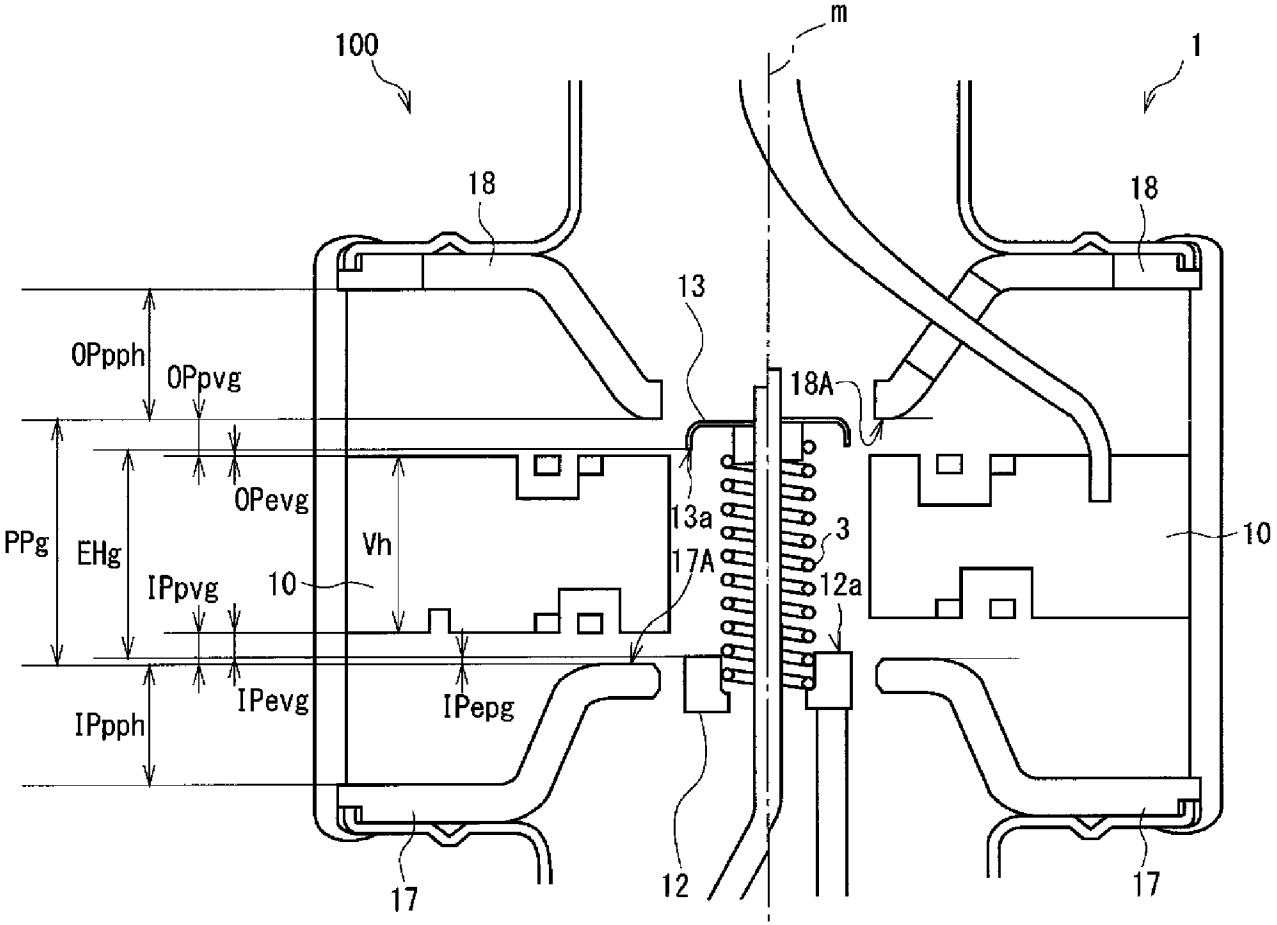
FIG. 4 is a longitudinal cross-sectional view showing dimensions of major portions of a magnetron according to an embodiment of the present invention and dimensions of major portions of a conventional magnetron.

With the use of FIG. 4, the difference in configuration between the magnetron of this embodiment and a magnetron to be compared (this is referred to as reference magnetron) 100 will be described. In FIG. 4 the right side in between the tube axis m is a longitudinal cross-sectional view of the magnetron 1 of this embodiment, and the left side is a longitudinal cross-sectional view of the reference magnetron 100. Comparing with the reference magnetron 100, the magnetron 1 of this embodiment is same in basic structure but mainly differs in the length, position and spacing of each section in the direction of a tube axis m, that constitutes an anode structure 2 and a cathode 3.

The reference magnetron 100 to be compared is a magnetron having the following dimensions. The height of vane Vh is 8.0 [mm] that is considered to be a lowest height in conventional practical application; a gap between end hats EHg is 8.9 [mm]; an input side end hat-vane gap IPevg is 0.8 [mm]; an output side end hat-vane gap OPevg is 0.1 [mm]; a gap between pole pieces PPg is 10.9 [mm]; an input side pole piece-vane gap IPpvg is 1.45 [mm]; also an output side pole piece-vane gap OPpvg is 1.45 [mm]; an input side end hat-pole piece gap IPepg is 0.65 [mm]; and both the height of input side pole piece IPpph and the height of output side pole piece OPpph are 6.25 [mm].

That is, the magnetron 1 of this embodiment has changed in comparison to the reference magnetron 100 as follows. The height of vane Vh is shortened by 0.5 [mm] from 8.0 to 7.5 [mm]; and the gap between pole pieces PPg is shortened by 0.6 [mm] from 10.9 to 10.3 [mm]. Accordingly, the magnetron 1 of this embodiment of which the length of an anode cylinder 6 in the direction of the tube axis m is shorter than that of the reference magnetron 100.

The gap between end hats EHg of the magnetron 1 is slightly widened in comparison to the reference magnetron 100 from 8.9 to 8.95 [mm]. The reason will be described later.

On the output side, the difference between the magnetron 1 of this embodiment and the reference magnetron 100 is only that the output side pole piece-vane gap OPpvg is slightly shortened by 0.15 [mm] from 1.45 to 1.30 [mm]: the output side end hat-vane gap OPevg and the height of output side pole piece OPpph of the magnetron 1 are equal to that of the reference magnetron 100. On the input side, the input side end hat-vane gap IPevg of the magnetron 1 is more widened than the reference magnetron 100 by 0.55 [mm] from 0.8 to 1.35 [mm], but the input side pole piece-vane gap IPpvg and the height of input side pole piece IPpph of the magnetron 1 are substantially equal to that of the reference magnetron 100.

In that manner, the output side of the magnetron 1 of this embodiment may have almost the same configuration as the reference magnetron 100, but on the input side, a gap between a vane 10 and an input side end hat 12 of the magnetron 1 is more widened than that of the reference magnetron 100. To put it simply, the magnetron 1 of this embodiment is that the height of vane 10 is more shortened than the reference magnetron 100 and the gap between the vane 10 and end hat 12 is more widened.

Figure 5:
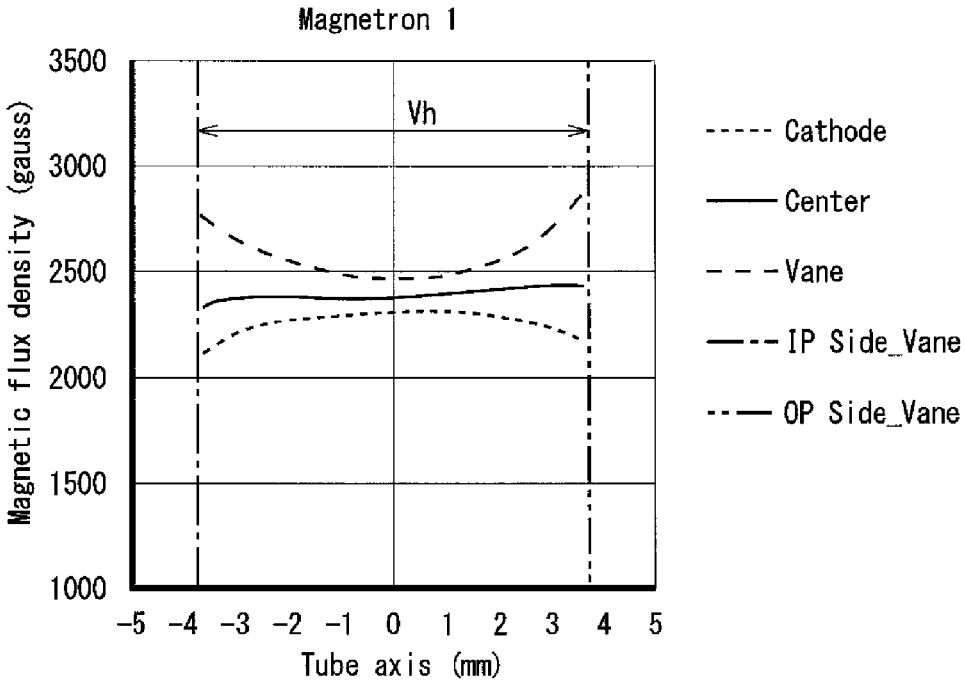
FIG. 5 is a graph chart showing an amount of magnetic flux density in an electron interaction space in a magnetron according to an embodiment of the present invention.
Figure 6:
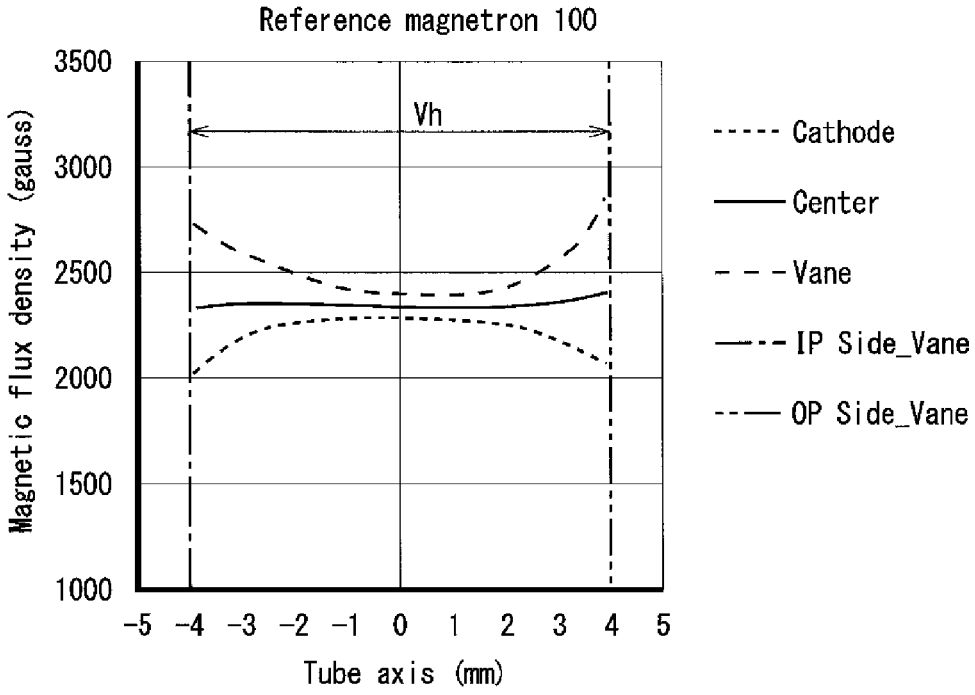
FIG. 6 (PRIOR ART)
FIG. 6 is a graph chart showing an amount of magnetic flux in an electron interaction space in a conventional magnetron.

The characteristics of the magnetron 1 of this embodiment will be described comparing with the characteristics of the reference magnetron 100. An amount of magnetic flux density in an electron interaction space will be described with respect to graphs of FIGS. 5 and 6. Incidentally, FIG. 5 accords to the magnetron 1 of this embodiment, FIG. 6 accords to the reference magnetron 100. In FIGS. 5 and 6, an ordinate represents magnetic flux density (gauss), an abscissa represents a position in an electron interaction space in the direction of a tube axis m. Incidentally, the abscissa is shown in a manner that the center of the height of vane Vh is set to zero, and a minus direction from the center is an input side and a plus direction is an output side. In FIGS. 5 and 6 magnetic flux density each obtained at the side of a vane 10 (Line-Vane), the center between the vane 10 and a cathode 3 (Line-Center) and the side of the cathode 3 (Line-Cathode), is shown.

As is clear from FIGS. 5 and 6, in the magnetron 1 of this embodiment, magnetic flux density slightly higher than the reference magnetron 100 is obtained at each the side of the vane 10, the center between the vane 10 and the cathode 3 and the side of the cathode 3. That is, in the magnetron 1 of this embodiment, the characteristics at the same level or greater than the reference magnetron 100 are obtained as to magnetic flux density in an electron interaction space.

Figure 7:
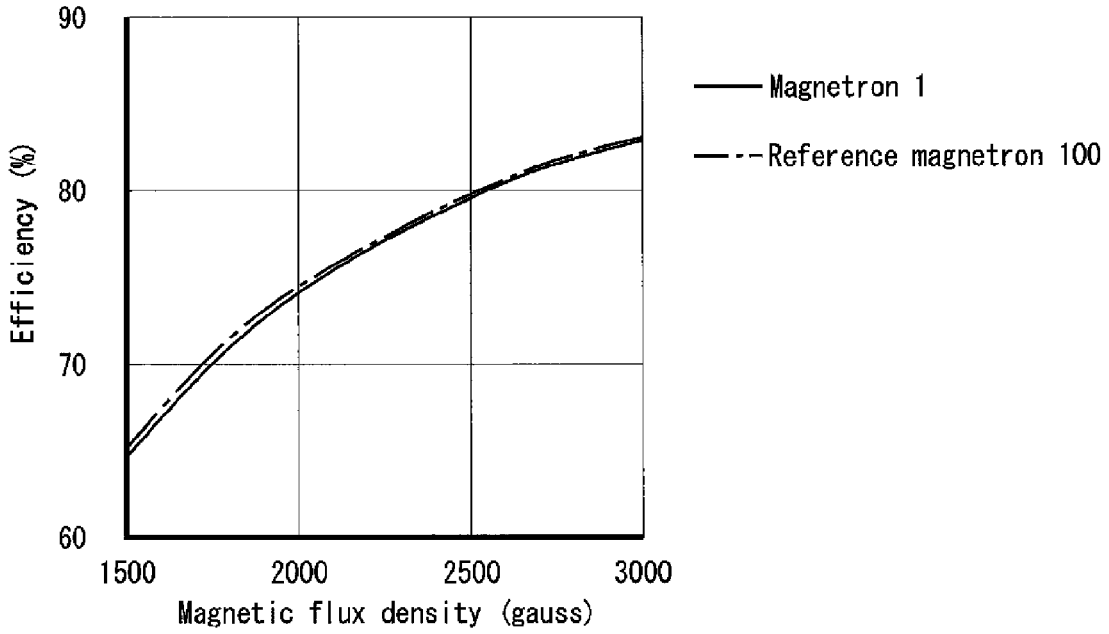
FIG. 7 is a graph chart showing electron efficiency to magnetic flux density in a magnetron according to an embodiment of the present invention and a conventional magnetron.
Figure 8:
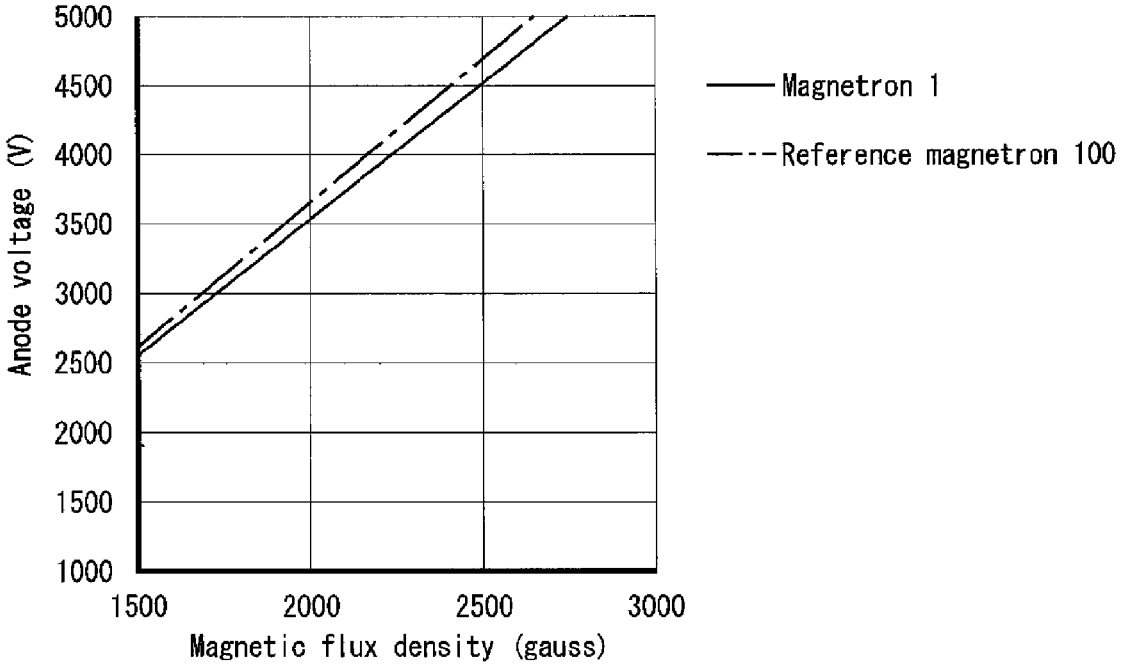
FIG. 8 is a graph chart showing anode voltage to magnetic flux density in a magnetron according to an embodiment of the present invention and a conventional magnetron.

Electron efficiency and anode voltage to magnetic flux density will be described with respect to graphs of FIGS. 7 and 8. In FIG. 7, an ordinate represents electron efficiency [%], an abscissa represents magnetic flux density [gauss]. In FIG. 8, an ordinate represents anode voltage [V], an abscissa represents magnetic flux density [gauss]. As is clear from FIGS. 7 and 8, in the magnetron 1 of this embodiment, the characteristics at the same level as the reference magnetron 100 are obtained as to electron efficiency and anode voltage to magnetic flux density.

Figure 9:
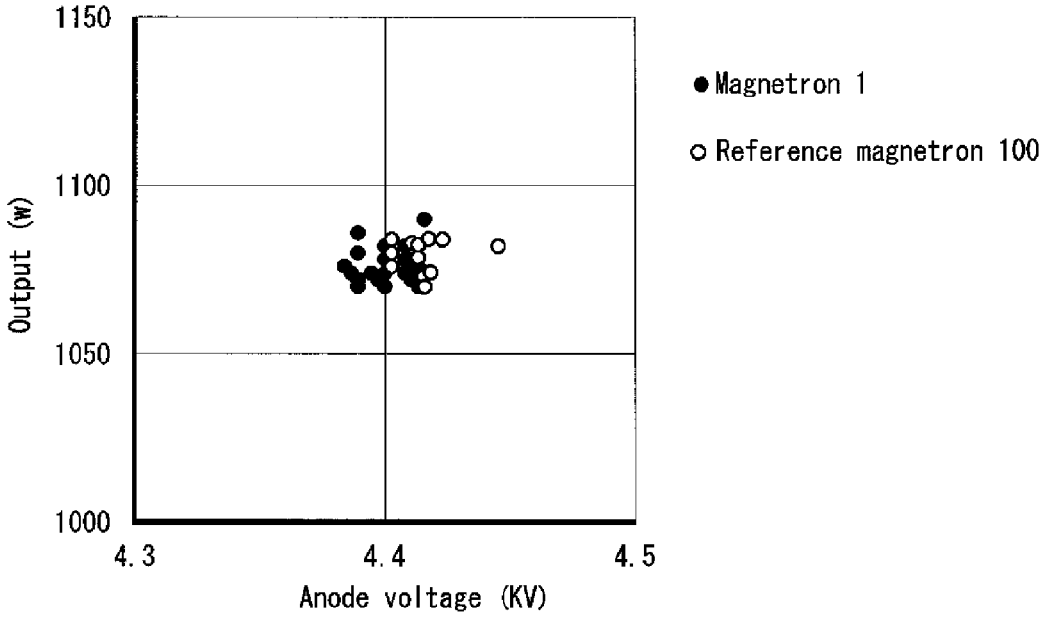
FIG. 9 is a graph chart showing output to anode voltage in a magnetron according to an embodiment of the present invention and a conventional magnetron.
Figure 10:
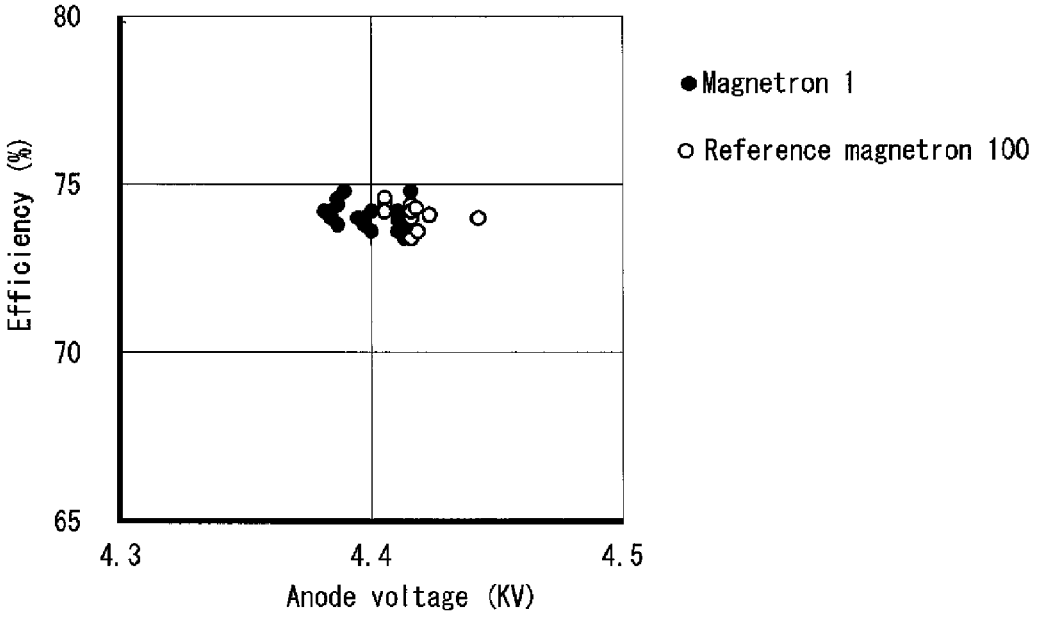
FIG. 10 is a graph chart showing output efficiency to anode voltage in a magnetron according to an embodiment of the present invention and a conventional magnetron.

Output and output efficiency to anode voltage of an actual magnetron will be described with respect to graphs of FIGS. 9 and 10. In FIG. 9, an ordinate represents output [w], an abscissa represents anode voltage [KV]. In FIG. 10, an ordinate represents output efficiency [%], an abscissa represents anode voltage [KV]. As is clear from FIGS. 9 and 10, in the magnetron 1 of this embodiment, the characteristics at the same level as the reference magnetron 100 are obtained also as to output and output efficiency to anode voltage.

Besides, in contrast with in the reference magnetron 100, load stability of approximately 1.35 [A] is obtained at high efficiency of approximately 74.5 [%], in the magnetron 1 of this embodiment, load stability of approximately 2.0 [A] is obtained at high efficiency of approximately 74.5 [%]. That is, in the magnetron 1 of this embodiment, load stability higher than the reference magnetron 100 is obtained while maintaining the high efficiency at the same level as the reference magnetron 100.

As described above, the magnetron 1 of this embodiment is at the same level of the reference magnetron 100 as to the characteristics except load stability, but the load stability is more improved while maintaining high efficiency at the same level of the reference magnetron 100.

Reasons why in the magnetron 1 of this embodiment the load stability can be improved while maintaining the high efficiency at the same level of the reference magnetron 100, will be described.

Figure 11:
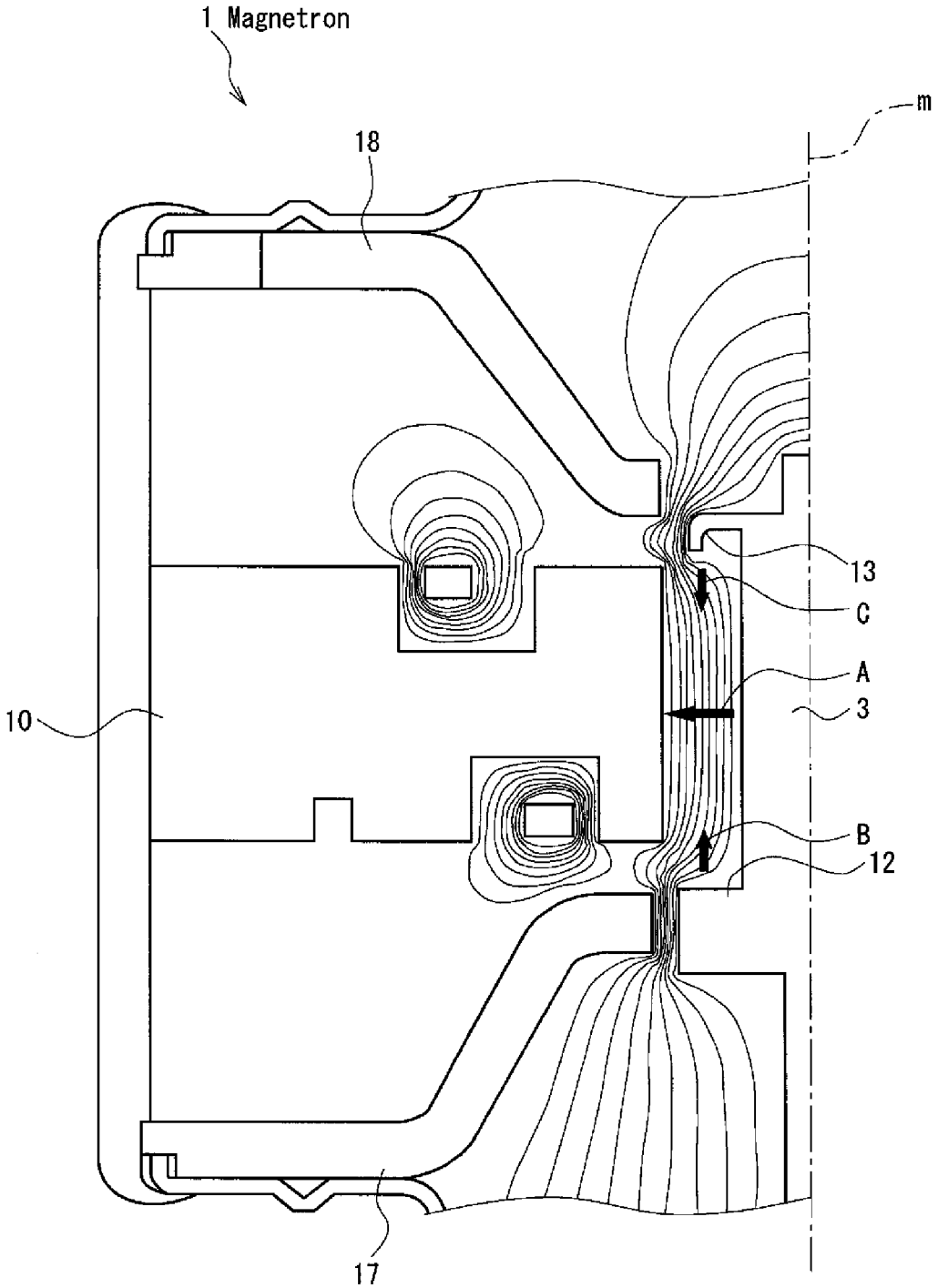
FIG. 11 is a longitudinal cross-sectional view showing electric field distribution in an electron interaction space in a magnetron according to an embodiment of the present invention.

In FIG. 11 electric field distribution in an electron interaction space is shown. FIG. 11 is a longitudinal cross-sectional view of an anode structure 2 and a cathode 3, in which electric field distribution in an electron interaction space in the direction of the tube axis m is represented by a plurality of equipotential lines. Incidentally, the electric field distribution is obtained by simulation by computer analysis. As shown in FIG. 11, in the electron interaction space between the cathode 3 and a vane 10, a plurality of equipotential lines align, which are parallel to the direction of the tube axis m (vertical direction in the diagram). Therefore, electrons move from the cathode 3 toward the vane 10 in a direction shown by an arrow A, that is perpendicular to the equipotential lines (or direction perpendicular to the tube axis m).

In order to stably oscillate such magnetron 1, in the whole area of an electron interaction space between free ends of the cathode 3 and vane 10, the equipotential lines preferably align in parallel to the direction of the tube axis m respectively, and the lines of magnetic force preferably align in the direction perpendicular to the direction of the tube axis m. Incidentally, such region in which a plurality of equipotential lines parallel to the direction of the tube axis m align in the direction perpendicular to the direction of the tube axis m is referred to as stable oscillation region.

By the way, at both ends of the electron interaction space in the direction of the tube axis m, there exist an input side end hat 12 and an output side end hat 13, so that a plurality of equipotential lines turn at the part to a direction substantially perpendicular to the direction of the tube axis m (side of the vane 10). As a result, in the vicinity of the input side end hat 12 and output side end hat 13 in the electron interaction space, as shown by arrows B and C, electrons receive force from both ends of the vane 10 to the center to the direction of the tube axis m. This force pushes back electrons to be emitted from the cathode 3 to the both ends of the vane 10 to the center of the vane 10.

By a pair of magnets 22 and 23, magnetic force is led to a cylindrical space surrounded by a free end of the vane 10, which is arranged on the inner periphery of an anode cylinder 6 by pole pieces 17, 18, and a magnetic field is formed in the direction of the tube axis m. Electrons in the electron interaction space move from the cathode 3 to the vane 10 in a direction shown by the arrow A, perpendicular to the equipotential lines (or direction perpendicular to the tube axis m), but electrons receives Lolentz force by Fleming's left hand rule by the magnetic field in the direction of the tube axis m, drawing a circulating orbit on the equipotential plane of an electric field.

In the magnetron 1 of this embodiment, for the purpose of reducing the force that restrains an electron group, trying to move from the cathode 3 to the vane 10, to the center of the vane 10 (arrow B), a gap between the vane 10 and the input side end hat 12 (input side end hat-vane gap IPevg) is more widened than the case of the reference magnetron 100.

By widening the gap between the vane 10 and the input side end hat 12 as the above, apart where a plurality of equipotential lines turn to the side of the vane 10 and align in a direction substantially parallel to the direction of the tube axis m (vertical direction in the diagram) becomes farther from an end of the free end of the vane 10 on the input side. As a result in the electron interaction space between the cathode 3 and the free end of the vane 10, equipotential lines parallel to the direction of the tube axis m extend to the end of the vane 10 on the input side: a stable oscillation region becomes wider toward the input side than the case of the reference magnetron 100. Consequently, in the vicinity of the end of the free end of the vane 10 on the input side, in comparison to the reference magnetron 100, suppressing force which acts on electrons to the direction of the tube axis m becomes weak (force toward the center of the free end of the vane 10, shown by arrow B), and also, the intervals of equipotential lines become gentle and suppressing force becomes uniform. Thereby, the motion area of electrons can be widened to the free end of the vane 10: load stability can be improved in comparison to the reference magnetron 100.

Incidentally, in the magnetron 1 of this embodiment, only the gap between the vane 10 and the input side end hat 12 is widened: the gap between the vane 10 and the output side end hat 13 is not widened. The reason is because in electrons leaked from between the vane 10 and the input side end hat 12 and between the vane 10 and the output side end hat 13, electrons leaked from the output side more affects on characteristics. Electrons leaked from the output side actually appears as noise in an output of the magnetron 1 through the antenna 21.

On the other hand, electrons leaked from the input side less affects on characteristics than electrons leaked from the output side because the former is removed by a filter box 27 and the like. Therefore, in the magnetron 1 of this embodiment, only the gap between the vane 10 and the input side end hat 12 (input side end hat-vane gap IPevg) is designed to be widened.

Figure 12:
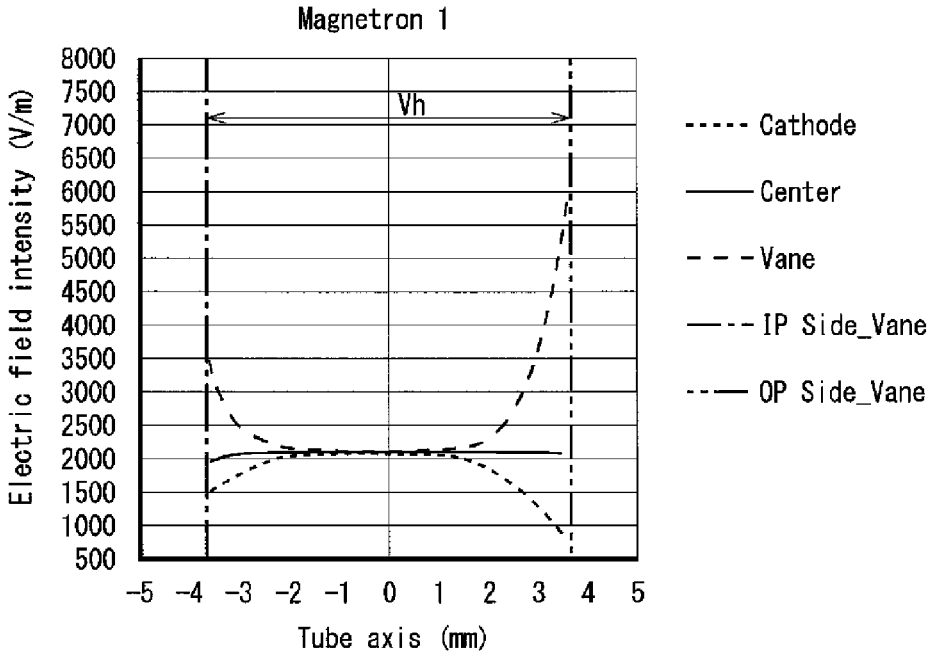
FIG. 12 is a graph chart showing electric field intensity in an electron interaction space in a magnetron according to an embodiment of the present invention.
Figure 13:
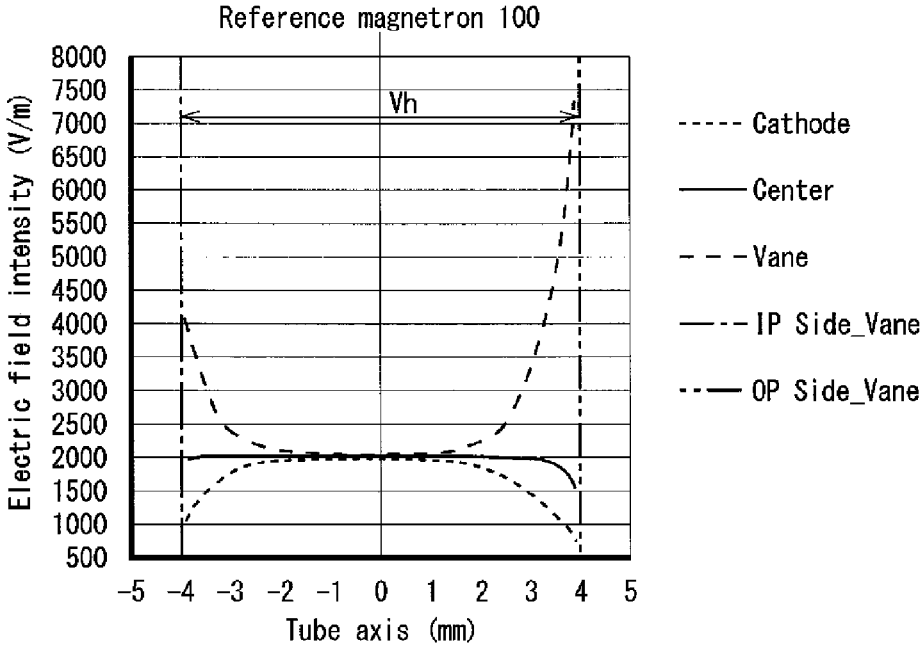
FIG. 13 (PRIOR ART)
FIG. 13 is a graph chart showing electric field intensity in an electron interaction space in a conventional magnetron.

A magnitude of electric field intensity in an electron interaction space will be described with respect to graphs of FIGS. 12 and 13. Incidentally, FIG. 12 accords with the magnetron 1 of this embodiment; FIG. 13 accords with the reference magnetron 100. In FIGS. 12 and 13, an ordinate represents electric field intensity [V/m], an abscissa represents a position in an electron interaction space in the direction of the tube axis m. In FIGS. 12 and 13 electric field intensity each obtained at the side of the vane 10 (Line-Vane), the center between the vane 10 and the cathode 3 (Line-Center) and the side of the cathode 3 (Line-Cathode), is shown.

As is clear from FIGS. 12 and 13, electric field intensity at the side of the vane 10 becomes larger near both ends of the vane 10 in the direction of the tube axis m. This shows that as shown in FIG. 11, near both ends of the vane 10 in the direction of the tube axis m, a plurality of equipotential lines turn to the side of the vane 10 and their intervals becomes narrow, and electric field intensity at the side of the vane 10 becomes larger. It means that the larger the electric field intensity at the side of the vane 10 near the both ends of the vane 10 in the direction of the tube axis m, the stronger the force acting on electrons to the direction of the tube axis m (force toward the center of the free end of the vane 10, shown by arrow B).

Comparing FIGS. 12 and 13, the magnetron 1 of this embodiment is smaller than the reference magnetron 100 in electric field intensity at the side of the vane 10 at an end of the vane 10 on the input side (−). From this, it is found that the magnetron 1 of this embodiment is weaker in the force acting on electrons in the direction of the tube axis m (force toward the center of the free end of the vane 10, shown by arrow B).

Besides, the magnetron 1 of this embodiment becomes larger than the reference magnetron 100 in the electric field intensity at the side of the cathode 3 (Line-Cathode), and the difference from the electric field intensity at the center between the vane 10 and the cathode 3 (Line-Center) becomes smaller. Also the difference from the electric field intensity at the side of the vane 10 (Line-Vane) becomes smaller. It shows that an equipotential surface becomes wider: it can be assumed that in the magnetron 1 of this embodiment a stable oscillation region in an electron interaction space extends to the input side. Also from these results, it is found that the magnetron 1 of this embodiment is weaker than the reference magnetron 100 in the force acting on electrons in the direction of the tube axis m (force toward the center of the free end of the vane 10, shown by arrow C), and also the suppressing force can be uniformly controlled.

By the way, if an input side end hat-vane gap IPevg is widened too much to the height of vane Vh, leakage of electrons is increased, and lowering of efficiency is feared. For this reason, an input side end hat-vane gap IPevg should be widened within the range capable of maintaining high efficiency at the same degree as the reference magnetron 100.

To widen an input side end hat-vane gap IPevg is also to widen a gap between end hats EHg. Therefore, the ratio of the height of vane Vh to a gap between end hats EHg is limited so as to be able to maintain high efficiency at the same degree as the reference magnetron 100 and so that electric field intensity at the side of the vane 10 becomes smaller than the reference magnetron 100 at the end of the vane 10 on the input side.

More specifically, from analysis results by simulation and the like, it has found that if the ratio of the height of vane Vh to a gap between end hats EHg (EHg/Vh) satisfies a condition $1.12 \leq EHg/Vh \leq 1.26$, high efficiency at the same degree as the reference magnetron 100 can be maintained and electric field intensity at the end of the vane 10 on the input side becomes smaller than the reference magnetron 100. Actually, the magnetron 1 of this embodiment of the ratio of the height of vane Vh to a gap between end hats EHg (EHg/Vh) is 8.95/7.5=1.19: this ratio satisfies the above condition. Therefore, the magnetron 1 of this embodiment can improve load stability while maintaining high efficiency at the same degree as the reference magnetron 100. In this connection, the reference magnetron 100 of the ratio of the height of vane Vh to a gap between end hats EHg (EHg/Vh) is 8.9/8.0=1.11: this ratio does not satisfy the above condition.

In the magnetron 1 of this embodiment, an input side pole piece-vane gap IPpvg is designed to be wider than an output side pole piece-vane gap OPpvg. These input side pole piece-vane gap IPpvg and output side pole piece-vane gap OPpvg are proportional to a gap between pole pieces PPg. The gap between pole pieces PPg is closely linked to magnetic flux density in an electron interaction space between the cathode 3 and the vane 10. herefore, it is necessary to select the ratio of a gap between pole pieces PPg to the height of vane Vh so that magnetic flux density in an electron interaction space between the cathode 3 and the vane 10 becomes the same degree as the reference magnetron 100.

More specifically, from the analysis results by simulation and the like, it has found that if the ratio of a gap between pole pieces PPg and the height of vane Vh (PPg/Vh) satisfies a condition 1.35≤PPg/Vh≤1.45, magnetic flux density in an electron interaction space becomes the same degree as the reference magnetron 100. Actually, the magnetron 1 of this embodiment of the ratio of a gap between pole pieces PPg to the height of vane Vh (PPg/Vh) is 10.3/7.5=1.37, satisfying the above condition.

In the magnetron 1 of this embodiment, as also shown in FIGS. 3 and 4, an input side end hat-vane gap IPevg becomes shorter than an input side pole piece-vane gap IPpvg. That is, the upper end 12*a* of the input side end hat 12 more protrudes than the flat surface 17A of the input side pole piece 17 to the side of the vane 10. One of the reasons of that is to suppress electrons to be leaked from an air hole at the central section of the input side pole piece 17. More specifically, it is desirable that the upper end 12*a* of the input side end hat 12 more protrudes than the flat surface 17A of the input side pole piece 17 to the side of the vane 10 within the range of 0 [mm] or more and 0.8 [mm] or less. Actually, the magnetron 1 of this embodiment of the upper end 12*a* of the input side end hat 12 more protrudes than the flat surface 17A of the input side pole piece 17 to the side of the vane 10 by 0.15 [mm].

The reason why in the magnetron 1 of this embodiment an output side end hat-vane gap OPevg becomes narrower than an input side end hat-vane gap IPevg is, as described above, that the output side is more affected than the input side by leakage of electron. Incidentally, in FIG. 2, the lower end 13*a* of the output side end hat 13 is located on the upper side (output side) than the upper end of the vane 10 (end of the output side), and a gap between these in such case is set as output side end hat-vane gap OPevg, but the lower end 13*a* of the output side end hat 13 may enter the central side of the free end of the vane 10 than the upper end of the vane 10 (end of the output side). Also a gap between these in this case is treated as output side end hat-vane gap OPevg. The output side end hat-vane gap OPevg and input side end hat-vane gap IPevg are proportional to the gap between end hats EHg: from the relation of conditional expressions EHg=(OPevg+IPevg+Vh) and 1.12≤EHg≤1.26 Vh, it becomes a conditional expression 0.12 Vh (OPevg+IPevg) ≤0.26 Vh. If limiting the range from empirical rule, it is desirable to be designed within the range of 0.9 [mm]≤(OPevg+IPevg)≤1.8 [mm] by selecting conditional expressions −0.1 [mm]≤OPevg≤0.5 [mm], 0.7 [mm]≤IPevg≤1.5 [mm].

In the magnetron 1 of this embodiment, the flat diameter of input side pole piece IPppd becomes larger than the flat diameter of output side pole piece OPppd. The shape of a pole piece is closely related to magnetic flux density in an electron interaction space, it is desirable to select the ratio of the flat diameter of input side pole piece IPppd to the flat diameter of output side pole piece OPppd (IPppd/OPppd). More specifically, the ratio of the flat diameter of input side pole piece IPppd to the flat diameter of output side pole piece OPppd (IPppd/OPppd) may satisfy a condition 1≤(IPppd/OPppd)≤1.34. Actually, the magnetron 1 of this embodiment of the ratio of the flat diameter of input side pole piece IPppd to the flat diameter of output side pole piece OPppd (IPppd/OPppd) is 14/12=1.17: it satisfies the above condition.

In the magnetron 1 of this embodiment, the ratio of the diameter of cathode 2 rc to the diameter of vane inscribed circle 2 ra (or the ratio of the radius of cathode rc to the radius of vane inscribed circle ra) becomes 0.463. This ratio (hereinafter referred to as rc/ra ratio) is closely related to efficiency and load stability, the larger the rc/ra ratio become, the higher load stability but the lower efficiency become. Therefore, in order to improve load stability while maintaining high efficiency at the same degree as the reference magnetron 100, also this rc/ra ratio becomes significant.

Therefore, it is desirable to select this rc/ra ratio in consideration of that point. More specifically, from the analysis results by simulation and the like, it has found that if this rc/ra ratio satisfies a condition 0.4≤rc/ra≤0.487, higher load stability can be obtained while maintaining high efficiency at the same degree as the reference magnetron 100. Actually, as described above, the magnetron 1 of this embodiment of the rc/ra ratio is 0.463: it satisfies the above condition.

In this manner, in the magnetron 1 of this embodiment, characteristics other than load stability are the same degree as the reference magnetron 100 and besides, load stability could be significantly improved by the following that: an input side pole piece-vane gap IPpvg is made to be larger than an output side pole piece-vane gap OPpvg; an input side end hat-vane gap IPevg is made to be larger than an output side end hat-vane gap OPevg; and the following is selected so as to satisfy the above conditions: the ratio of the height of vane Vh to a gap between end hats EHg; the sizes of an output side end hat-vane gap OPevg and an input side end hat-vane gap IPevg; the ratio of a gap between pole pieces PPg to the height of vane Vh; a projecting amount of the input side end hat 12 to the side of the vane 10; the ratio of the flat diameter of input side pole piece IPppd to the flat diameter of output side pole piece OPppd; and the ratio of the radius of cathode rc to the radius of vane inscribed circle ra. Incidentally, all of these conditions may not be necessarily satisfied, at least the following may be satisfied that: an input side pole piece-vane gap IPpvg is made to be larger than an output side pole piece-vane gap OPpvg; an input side end hat-vane gap IPevg is made to be larger than an output side end hat-vane gap OPevg; and the ratio of the height of vane Vh to a gap between end hats EHg satisfies the above condition. The remaining conditions may be selectively satisfied according to specifications to be required.

The comparison result of efficiency to load stability will be described with the use of the magnetron 1 of this embodiment, the reference magnetron 100 and a plurality of magnetrons different from these.

The length and spacing of the main section of magnetrons used in simulation is shown in a table of FIG. 14. In this table, five kinds of magnetrons No. 1 to No. 5 are described: of these No. 5 accords to the magnetron 1 of this embodiment, No. 3 accords to the reference magnetron 100.

Of these five kinds of magnetrons, magnetrons No. 1 to No. 4 except No. 5 that is the magnetron 1 of this embodiment, of the height of vane Vh is equal to or higher than 8.0 [mm]. Only the magnetron No. 5 or the magnetron 1 of this embodiment is that: an input side pole piece-vane gap IPpvg is larger than an output side pole piece-vane gap OPpvg; an input side end hat-vane gap IPevg is larger than an output side end hat-vane gap OPevg; and the ratio of the height of vane Vh to a gap between end hats EHg satisfies the above condition.

Figure 15:
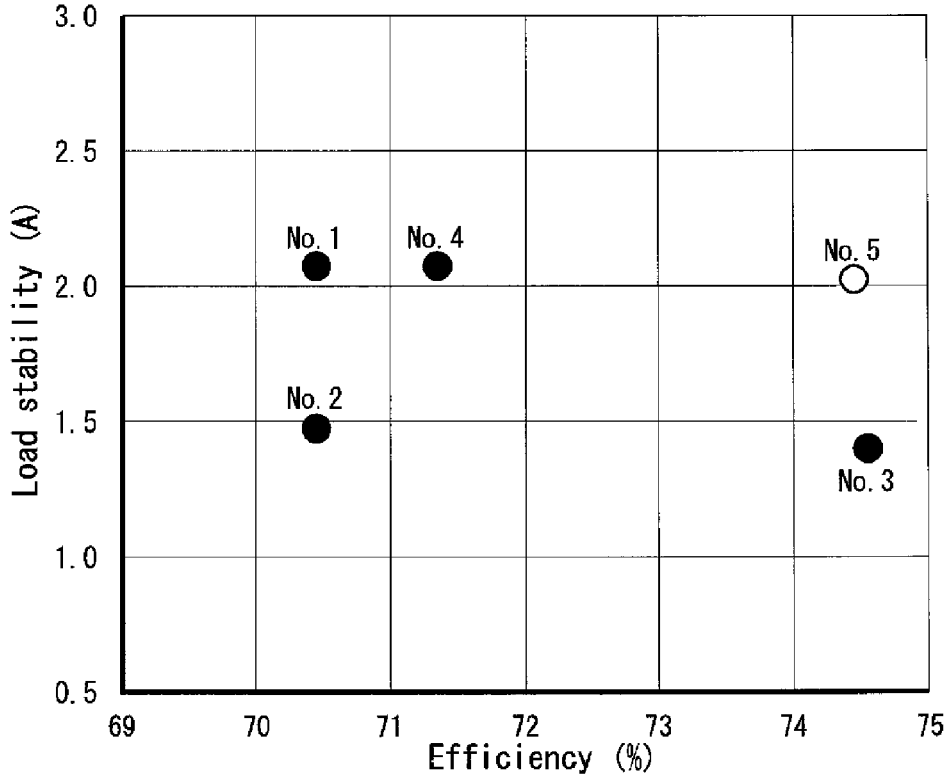
FIG. 15 is a graph chart showing output efficiency and load stability in a plurality of magnetrons including a magnetron according to an embodiment of the present invention.

Efficiency and load stability obtained from each of these five kinds of magnetrons No. 1 to No. 5 is shown in a graph of FIG. 15. In FIG. 15, an ordinate represents load stability [A], an abscissa represents efficiency [%]. As is clear from FIG. 15, in the magnetron No. 5 that is the magnetron 1 of this embodiment, although the height of vane Vh is shorter than the other magnetrons No. 1 to No. 4, high load stability of approximately 2.0 [A] could be obtained at high efficiency of approximately 74.5 [%].

Of these magnetrons No. 1 to No. 4, that can obtain the highest load stability at high efficiency of 74-75 [%] degree is the magnetron No. 3, but it is approximately 1.35 [A]: it is lower than about 0.65 [A] than the magnetron No. 5. The magnetron No. 1 of load stability is high that is approximately 2.1 [A], but efficiency is 70% degree: it is lower than the magnetron No. 5 by approximately 4%. It has found that the magnetron 1 of this embodiment (magnetron No. 5) has high efficiency and its load stability is high even in comparison to other various magnetrons.

Figure 16:
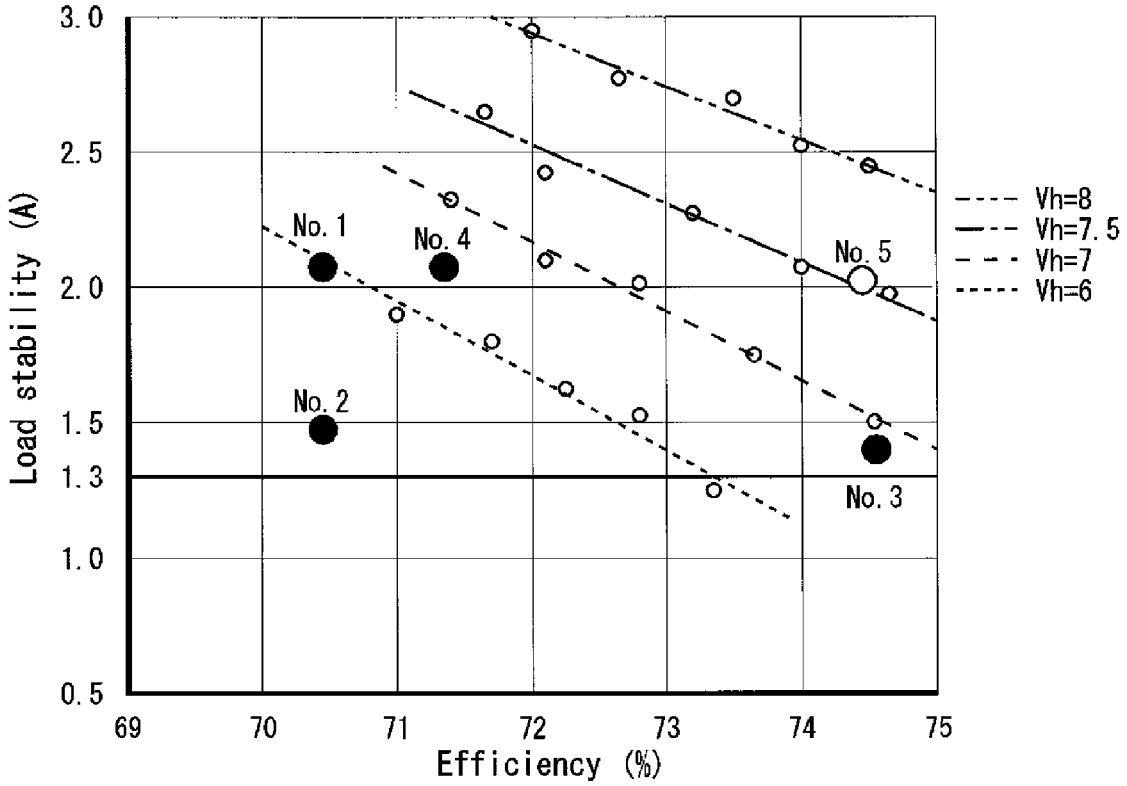
FIG. 16 is a graph chart showing variations in output efficiency and load stability when the height of vanes of a magnetron according to an embodiment of the present invention is changed.

A relation between efficiency and load stability of the magnetron 1 of this embodiment (magnetron No. 5) is shown in a graph of FIG. 16. In FIG. 16, similarly to FIG. 15, an ordinate represents load stability [A], an abscissa represents efficiency [%].

In FIG. 16, a change in efficiency and load stability in the magnetron 1 having the height of vane Vh=7.5 [mm] is shown by alternate long and short dashed lines. As is clear from the alternate long and short dashed line, a relation between efficiency and load stability is that one increases if the other decreases, so-called trade-off relation. Incidentally, as described above, efficiency and load stability is closely related to rc/ra ratio: by changing the rc/ra ratio of the magnetron 1 by the simulation, efficiency and load stability obtained by the magnetron 1 has changed.

Actually, in the magnetron 1 of this embodiment, load stability is approximately 2.0 [A] at an efficiency of approximately 74 [%]. If decreasing the efficiency up to 71.5% degree, the load stability increases up to 2.7 [A] degree. That is to say, high load stability equal to or higher than 2.0 [A] can be obtained at efficiency of less than 75%.

Also a relation between efficiency and load stability in the case where the height of vane Vh of the magnetron 1 of this embodiment has changed to 8.0 [mm], 7.0 [mm], 6.0 [mm] is shown in the graph of FIG. 16. Incidentally, if the height of vane Vh is changed, the above conditions are satisfied. In FIG. 16, change in efficiency and load stability in the case where the height of vane Vh has changed to 8.0 [mm] is shown by alternate long and two short dashed lines; change in efficiency and load stability in the case where the height of vane Vh has changed to 7.0 [mm] is shown by long dashed lines; change in efficiency and load stability in the case where the height of vane Vh has changed to 6.0 [mm] is shown by short dashed lines.

In the case where the height of vane Vh has changed to 8.0 [mm], as is clear from the alternate long and two short dashed lines, load stability is approximately 3.0 [A] at efficiency of approximately 72 [%], load stability becomes approximately 2.5 [A] at efficiency of approximately 74.5 [%]. That is, in this case, higher load stability could be obtained than the case where the height of vane Vh is 7.5 [mm] if efficiency is at the same degree. It can be inferred that this is because if the height of vane Vh is higher, also the length of a stable oscillation region in the direction of a tube axis m becomes longer by that.

In the case where the height of vane Vh has changed to 7.0 [mm], as is clear from the long dashed lines, load stability is approximately 2.5 [A] at efficiency of approximately 71.5 [%], load stability becomes approximately 1.5 [A] at efficiency of approximately 74.5 [%]. That is, in this case, lower load stability is obtained than the case where the height of vane Vh is 7.5 [mm] if efficiency is at the same degree. It can be inferred that this is because if the height of vane Vh is lower, also the length of a stable oscillation region in the direction of the tube axis m becomes shorter by that.

In the case where the height of vane Vh has changed to 6.0 [mm], as is clear from the short dashed lines, load stability is approximately 1.9 [A] at efficiency of approximately 71 [%], load stability becomes approximately 1.2 [A] at efficiency of approximately 73.5 [%]. That is, in this case, load stability becomes further lower than the case where the height of vane Vh is 7.0 [mm] if efficiency is at the same degree.

In this manner, it can be found that if enlarging the height of vane Vh of the magnetron 1, load stability at the same efficiency becomes higher, and if reducing the height of vane Vh, load stability at the same efficiency becomes lower.

By the way, in magnetrons used in household microwave ovens, as a guide of operation stability at high efficiency, load stability equal to or higher than 1.3 [A] at high efficiency of 70-75 [%] is required. Actually, this requirement can be satisfied in the cases where the height of vane Vh is 8.0, 7.5, 7.0 [mm]; in the case where the height of vane Vh is 6.0 [mm], this requirement cannot be satisfied.

Additionally, in the case where the height of vane Vh is 6.0 [mm], for instance, in comparison to the magnetron No. 3, it cannot be said that load stability is higher at the same efficiency. Therefore, from these, it is desirable to make the height of vane Vh of the magnetron 1 equal to or higher than 7.0 [mm]. On the other hand, it can be considered that if making the height of vane Vh equal to or higher than 8.0 [mm], load stability at the same efficiency improves, but the cost increases.

Therefore, in order to improve load stability at high efficiency while suppressing costs, it is desirable to make the height of vane Vh equal to or higher than 7.0 [mm] and shorter than 8.0 [mm].

As described above, in the magnetron 1 of this embodiment, in spite of the fact that the height of vane Vh is shortened in a manner that the ratio of the height of vane Vh to a gap between end hats EHg (EHg/Vh) satisfies a condition $1.12 \leq EHg/Vh \leq 1.26$; an input side pole piece-vane gap IPpvg becomes larger than an output side pole piece-vane gap OPpvg; and an input side end hat-vane gap IPevg becomes larger than an output side end hat-vane gap OPevg, load stability could be improved while maintaining high efficiency similarly to the reference magnetron 100.

Besides, by shortening the height of vane Vh as the above, the length of an anode cylinder 6 in the direction of a tube axis m can be more shortened than the reference magnetron 100. As a result, a gap between magnets 22 and 23 can be narrowed. Thereby, for instance, magnets 22 and 23 can be changed to magnets which are lower in performance and cost than the magnets used in the reference magnetron 100. Not only limiting to this, if using magnets having the same performance as the reference magnetron 100, also magnetic field intensity in an electron interaction space can be improved by that a gap between the magnets 22 and 23 become narrow.

As a result, it is possible to provide a magnetron improved in high efficiency and load stability while suppressing costs.

Incidentally, the above-described embodiment is one example. The present invention is also applicable to a magnetron that high load stability at high efficiency is required, not only magnetrons used in household microwave ovens.

While there has been described in connection with the preferred embodiments of the present invention, it will be obvious to those skilled in the art that various changes, modifications, combinations, sub-combinations and alternations may be aimed, therefore, to cover in the appended claims all such changes, and modifications as fall within the true spirit and scope of the present invention.

What is claimed is:

1. A magnetron comprising:

an anode cylinder extending cylindrically along a central axis of the magnetron extending from an input side to an output side;

a plurality of vanes extending from an inner surface of the anode cylinder toward the central axis with free ends forming a vane inscribed circle;

a cathode disposed along the central axis in the vane inscribed circle formed by the free ends of the plurality of vanes;

an input side end hat and an output side end hat respectively fixed to an input side end and an output side end of the cathode;

an input side pole piece and an output side pole piece respectively disposed at an input side end and an output side end of the anode cylinder in the central axis direction to lead magnetic flux into an electron interaction space between the free ends of the plurality of vanes and the cathode; and magnets respectively disposed outside of the input side pole piece and the output side pole piece in the central axis direction;

wherein when a gap between the input side end hat and output side end hat is represented by gap between end hats EHg, a length of the vanes in the central axis direction is represented by height of vane Vh, a gap between the input side end hat and an input side end of the vanes is represented by input side end hat-vane gap IPevg, a gap between the output side end hat and an output side end of the vanes is represented by output side end hat-vane gap OPevg, a gap between a central part of a flat surface of the input side pole piece and the input side end of the vanes is represented by input side pole piece-vane gap IPpvg, a gap between a central part of a flat surface of the output side pole piece and the output side end of the vanes is represented by output side pole piece-vane gap OPpvg, and when a gap between a central part of a flat surface of the input side pole piece and the central part of the flat surface of the output side pole piece is represented by PPg, conditional expressions 7.0 (mm)≤Vh≤8.0 (mm), 1.12≤EHg/Vh≤1.26, IPpvg>OPpvg, IPevg>OPevg, and 1.35≤PPg/Vh≤1.45 are satisfied.

2. The magnetron according to claim 1, wherein a conditional expression 0.9 (mm)≤(OPevg+IPevg)≤1.8 (mm) is satisfied.

3. The magnetron according to claim 1, wherein the input side end hat protrudes to a vane side more than the central part of the flat surface of the input side pole piece.

4. The magnetron according to claim 3, wherein when a diameter of the central part of the flat surface of the input side pole piece is represented by flat diameter of input side pole piece IPppd, and a diameter of the central part of the flat surface of the output side pole piece is represented by flat diameter of output side pole piece OPppd, a conditional expression 1≤IPppd/OPppd≤1.34 is satisfied.

5. The magnetron according to claim 4, wherein when a radius of the vane inscribed circle is represented by radius of vane inscribed circle ra, and a radius of an outer periphery of the cathode is represented by radius of cathode rc, a conditional expression 0.45≤rc/ra≤0.487 is satisfied.

* * * * *